US006338337B1

(12) United States Patent
Panz et al.

(10) Patent No.: US 6,338,337 B1
(45) **Date of Patent: *Jan. 15, 2002**

(54) TWO-STAGE HEAT RECOVERY FOR SUBMERGED COMBUSTION HEATING SYSTEM

(75) Inventors: Eric Leopold Panz; Steven Eric Panz; Joseph Lech Jachniak, all of Vancouver (CA)

(73) Assignee: Inproheat Industries Ltd., Vancouver (CA)

( * ) Notice: Subject to any disclaimer, the term of this patent is extended or adjusted under 35 U.S.C. 154(b) by 0 days.

This patent is subject to a terminal disclaimer.

(21) Appl. No.: 09/410,125

(22) Filed: Sep. 30, 1999

(51) Int. Cl.[7] ..... F24H 1/20
(52) U.S. Cl. ..... 126/360.2; 122/31.2
(58) Field of Search ..... 126/306.2; 122/31.2; 210/180, 775, 766; 159/16.2

(56) References Cited

U.S. PATENT DOCUMENTS 2,867,972 A * 1/1959 Holderreed et al.
3,005,288 A * 10/1961 McGugin et al.
3,060,921 A * 10/1962 Luring et al.
3,209,745 A * 10/1965 Glaser et al. ..... 126/362.2
3,432,399 A * 3/1969 Schutt
3,840,002 A * 10/1974 Douglas et al.
4,141,343 A * 2/1979 Awano et al.
4,719,878 A * 1/1988 Austry et al.
5,032,230 A 7/1991 Shephard
5,097,802 A * 3/1992 Clawson
5,342,482 A * 8/1994 Duesel, Jr.
5,606,965 A 3/1997 Panz et al.
5,615,668 A 4/1997 Panz et al.
5,636,623 A 6/1997 Panz et al.

FOREIGN PATENT DOCUMENTS

| | | |
|---|---|---|
| EP | 0118363 | * 9/1984 |
| EP | 0181248 | * 5/1986 |
| JP | 53-146347 | * 12/1978 |
| JP | 56-108039 | * 8/1981 |

* cited by examiner

*Primary Examiner*—Carl D. Price
(74) *Attorney, Agent, or Firm*—Oyen Wiggs Green & Mutala

(57) ABSTRACT

This invention relates to a novel two-stage heat recovery submerged combustion heating system. More particularly, this invention relates to a novel submerged combustion heating system with a lowered self-cooling combustion chamber and a two stage heat recovery system. The system can be installed singly or in combination with other similar submerged combustion systems to heat large quantities of liquids and liquid-solid solutions.

6 Claims, 3 Drawing Sheets

TWO-STAGE HEAT RECOVERY FOR SUBMERGED COMBUSTION HEATING SYSTEM

FIELD OF THE INVENTION

This invention relates to a novel two-step heat recovery submerged combustion heating system. More particularly, this invention relates to a novel submerged combustion heating system with a lowered self-cooling combustion chamber and a two-stage heat recovery system. The system can be installed singly or in combination with other similar submerged combustion systems to heat large quantities of liquids and liquid-solid solutions.

BACKGROUND OF THE INVENTION

Submerged combustion heating is a method whereby hot products of combustion are forced through a liquid or liquid-solid mixture to heat the liquid or liquid-solid mixture. A major advantage of this heating system is that the heat exchange occurs directly between the hot gaseous products of combustion and the liquid. Thus there is no solid interface that interferes with heat exchange. In a submerged combustion system, the hot combustion products a which is typically fuelled by a combination of air and natural gas. The flame generates hot combustion gases which contact the liquid to be heated, but the flame itself does not come into contact with the liquid.

This submerged combustion technology differs from conventional heat exchange methods such as immersion tube heating where the heat exchange is indirect through a solid interface and the products of combustion are exhausted directly to the atmosphere, rather than being forced through the liquid. Submerged combustion can be utilized to heat liquids with overall system efficiency greater than 90%. Conventional hot water boiler indirect heating systems have an efficiency of about 80%. Immersion tube heating systems are relatively low performers and have an efficiency of about 70%.

In applications where separation of components by distillation or absorption is required, submerged combustion heating can be applied to generate liquid or liquid-solid temperatures up to about 195° F. This is not much below the boiling point of water, and is applicable to most industrial and domestic liquid or liquid-solids heating applications.

In addition to high efficiency, submerged combustion heating systems are advantageous because they maintain a uniform temperature throughout the liquid in which the submerged combustion is conducted. This is because the hot gaseous combustion products pass rapidly through the liquid and keep the liquid in constant agitation, thereby distributing heat evenly. Submerged combustion heating systems are also suitable for heating contaminated liquids, or liquids with low medium or high solids contents. Expenses are usually lower than with other heating systems because the submerged combustion heating can be conducted in a liquid holding tank which can operate at ambient pressures, thereby eliminating the need to be pressurized. Unlike boiler heating applications, a certified operating engineer is not required to operate a submerged combustion heating system.

Typical industrial applications for submerged combustion systems include: (a) natural gas processing plants for effluent pond heating; (b) municipal effluent holding and treatment ponds - which can include maintenance of pond temperatures to ensure continuous high level of biological degradation especially in regions that experience extreme seasonal temperature changes, and in other cases, elevated temperatures to pasteurize the effluent; (c) aggregate wash plants for heating aggregate wash water at concrete batch plants; (d) log ponds and conditioning chests for heating log ponds and conditioning vats in plywood, veneer, orientated strand board (OSB), waferboard, chopstick plants; (e) pulp and paper for mill water intake protection against freezing, white water solution heating; (f) heap leach mining for heating of barren solutions for ore extraction in heap leaching operations; (g) wet potash mining for heating of barren brine solution to maximize solubility and recovery of potash in flooded potash mines; (h) coal thawing for conveying; (i) carpet and fabric manufacturing for heating of bulk carpet and fabric dyes; (j) cogeneration for evaporation of waste water to recover water treatment chemicals in plants with zero effluent discharge; and (k) industrial processes—processes requiring large volumes of hot water or non-flammable liquids, or processes requiring a direct source of heat for distillation or absorption.

Typical commercial applications for submerged combustion systems include: (a) swimming pool heating—institutional and residential; (b) fish hatcheries—fresh water heating; (c) commercial laundries—wash water heating; (d) automotive car washes; (e) snow disposal; (f) food processing plants, and municipal waste disposal systems.

The applicant is the assignee of one or more of the inventors herein and therefore the owner of the following patents relating to a submerged combustion heating system:

1. U.S. Pat. No. 5,606,965, granted Mar. 4, 1997 entitled "Submerged Combustion System";
2. U.S. Pat. No. 5,615,668, granted Apr. 1, 1997, entitled "Apparatus for Cooling Combustion Chamber in a Submerged Combustion Heating System"; and
3. U.S. Pat. No. 5,636,623, granted Jun. 10, 1997, entitled "Method and Apparatus for Minimizing Turbulence in a Submerged Combustion System".
4. U.S. Pat. No. 5,032,230, Sheppard, discloses a secondary heat recovery system using vacuum.

The subject matter and contents of these three aforementioned U.S. patents is incorporated herein by reference.

SUMMARY OF THE INVENTION

The invention is directed to a submerged combustion heating system comprising: (a) a first liquid holding vessel, said first holding vessel having a liquid inlet and a liquid outlet, and an exhaust gas outlet; (b) a combustion chamber positioned in the interior of the first vessel, at least the bottom portion of the combustion chamber being located below the top elevation of the vessel and in the liquid in the first tank; (c) fuel and air conveyors associated with the combustion chamber for conveying fuel and air into the interior of the combustion chamber, said fuel and air being ignited to create a combustion flame inside the combustion chamber, said flame not touching the interior walls of the combustion chamber or the liquid, said flame generating a hot combustion gas; (d) a plurality of openings located in the combustion chamber for enabling the hot combustion gas to be exhausted from the interior of the combustion chamber into liquid in the first vessel below the level of liquid in the first vessel and heating the liquid in the first vessel; (e) a second liquid holding vessel connected to the first vessel and holding liquid; (f) a hot air chamber positioned in the interior of the second liquid vessel and connected with the first vessel, said hot air chamber being connected to and receiving hot combustion gas from the first vessel and exhausting the hot combustion gas through the liquid in the liquid in the second liquid holding vessel and heating the liquid in the second vessel.

The submerged combustion heating system can include a first liquid level control for controlling level of liquid in the first holding vessel so that the level of the top of the liquid is above the plurality of openings in the combustion chamber, and above the liquid inlet but at or below the level of the liquid outlet, and a liquid level control for controlling level of liquid in the second holding vessel, said hot combustion gas transferring heat from the hot combustion gas to the liquid in the first vessel and the liquid in the second vessel. A weir can prevent hot combustion gas from exiting the first vessel through the liquid outlet.

The plurality of openings can be located in the lower region of the combustion chamber and horizontally encircle the periphery of the combustion chamber.

The first vessel can be a hollow cylindrical vessel, having vertical walls, a first bottom, a first top and a first vertical longitudinal axis, and the combustion chamber can be a smaller hollow cylindrical vessel which can have vertical walls, a second bottom, a second top, a second vertical longitudinal axis coincident to the first longitudinal axis of the first cylindrical vessel, and the plurality of openings is located in the lower region of the smaller cylindrical vessel. The top portion of the smaller cylindrical vessel can have a truncated conical shape. The openings can be vertical slots in the lower region of the combustion chamber.

Liquid level in the first vessel can be maintained at a level above the first bottom of the first vessel and above the bottom of the smaller cylindrical vessel and the plurality of openings in the smaller cylindrical vessel, but below the first top of the first vessel, and the portion of the smaller cylindrical vessel comprising the truncated conical shape, the exterior surface of the truncated conical shape portion of the second cylindrical vessel being cooled by wave action created in the liquid in the first vessel by hot combustion gas bubbles generated in the smaller cylindrical vessel and exiting from the plurality of openings and rising to the surface of the liquid being heated in the first vessel; and the level of liquid in the second holding vessel can be maintained at a level above the bottom of the second holding vessel and the hot air chamber, the hot combustion gas from the hot air chamber passing through and heating the liquid in the second vessel.

The combustion chamber can be enclosed by a jacket and hot combustion gas from the combustion chamber openings can pass through the liquid in the first vessel between the combustion chamber and the jacket.

The fuel and air conveyors can convey the fuel and air to a nozzle which can combine the fuel and air for combustion, said nozzle being positioned above the top interior of the combustion chamber. The smaller cylindrical vessel comprising the combustion chamber can have an open bottom.

The second liquid holding vessel can have a plurality of openings spatially distributed around the bottom circumference of the second liquid holding vessel. The second liquid holding vessel can have a conduit which can introduce hot combustion gas into the second liquid holding vessel and the conduit can have a cap thereon which can force the hot combustion gas to pass through the liquid in the secondary holding vessel. The liquid in the second holding vessel can be liquid obtained from the first liquid holding vessel.

The liquid to be heated can be introduced to the second holding vessel and can then pass from the second holding vessel to the first liquid holding vessel with the combustion chamber. The hot combustion gas from the first liquid holding vessel can be passed to the hot air chamber in the second liquid holding vessel.

The submerged combustion system can include a computer which can sense the temperature of the exhaust gas, and the temperatures of the cold liquid being introduced into the first vessel or the second vessel, and the temperatures of the heated liquid being conveyed from one liquid holding vessel to the other, and the temperature of hot liquid being withdrawn from the first or second liquid holding vessel, and can prompt appropriate valves to open when the temperature of the exhaust gas is higher than the temperature of the hot liquid being withdrawn from the first or second liquid holding vessels and can prompt the appropriate valves to close when the temperature of the exhaust gas is the same as the temperature of the hot liquid being withdrawn from the system.

The jacket surrounding the combustion chamber can be in the shape of a hollow cylinder. The jacket can be tapered in an upwardly direction.

BRIEF DESCRIPTION OF THE DRAWINGS

In drawings which illustrate specific embodiments of the invention but which should not be construed as limiting or restricting the spirit or scope of the invention in any way.

DETAILED DESCRIPTION OF THE PREFERRED EMBODIMENT

Figure 1:
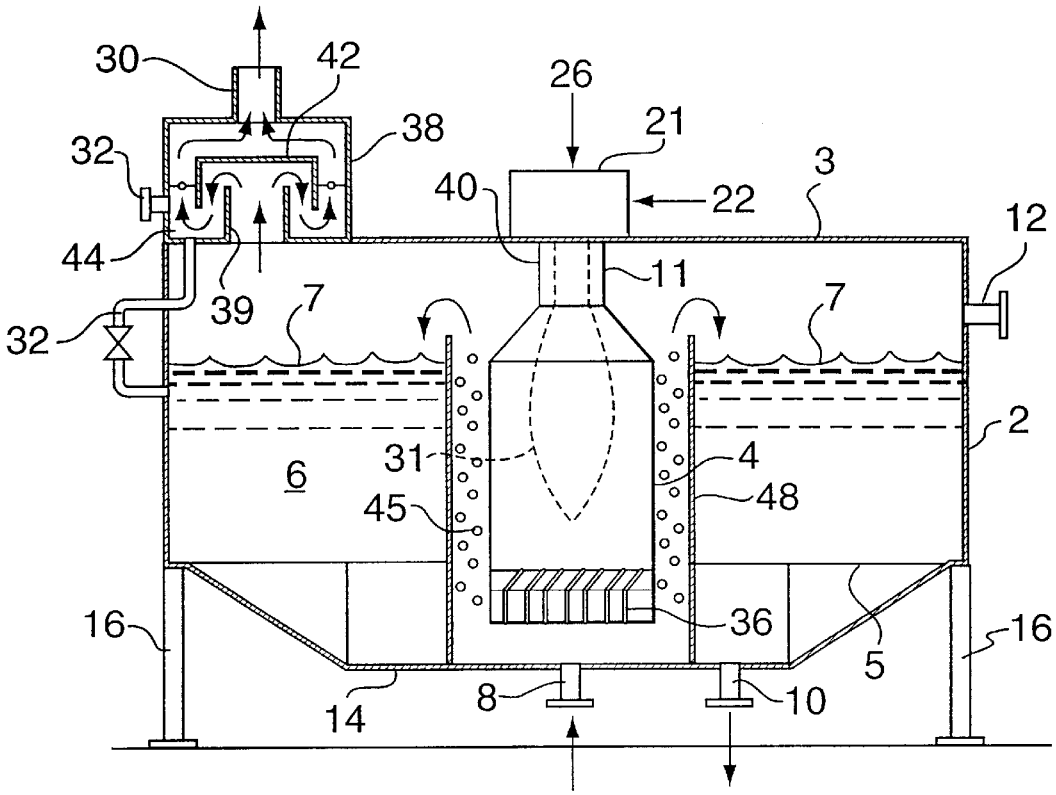
FIG. 1 illustrates a schematic elevation view of a submerged combustion heating system including a liquid heating tank and a submerged combustion chamber of a lowered design installed in the interior thereof, and a secondary heat recovery dome.

Referring to FIG. 1, which illustrates a schematic elevation view of a submerged combustion heating system including a liquid heating tank and a submerged combustion chamber of a lowered design, and a secondary heat recovery dome, the system comprises a liquid holding heating tank 2 which has a flat top 3 and flat bottom 5. The tank 2 holds a liquid 6 which has a top level 7. Extending axially downwardly in the central area of the tank 2 through a downwardly recessed opening in the top plate 3 is a hollow cylindrical combustion chamber 4. Specifically, the top plate 3 of the tank 2 has a downwardly extending recess 9 in the central region which enables sleeve 40 under burner 21 and all of the combustion tank 4 and conical upper section 11 to be positioned below the top plate 3 of the tank 2. The underside of burner nozzle housing 21 positioned at the top of the combustion chamber 4, in top plate recess 9, connects with sleeve 40, which in turn connects with the top end of truncated cone 11. This recessed top plate 3 design enables the combustion chamber 4 to be positioned at a lower elevation in the tank 2 and differs from the combustion chamber design in U.S. Pat. No. 5,606,965. In this lowered design, according to the invention, all the vertical side walls of the combustion chamber 4 are below liquid level 7, thereby eliminating the need to separately cool the upper walls of the combustion chamber 4, as required in the prior design in U.S. Pat. No. 5,606,965. The combustion chamber 4 has a truncated conical top portion 11 which extends above the level 7 of the liquid 6. The combustion chamber 4 can be removed for maintenance. The construction of this lowered combustion chamber 4 will be discussed in detail below.

The level of liquid 6 in the liquid holding tank 2 is depicted by liquid level line 7. Liquid 6 to be heated by submerged combustion is introduced into tank 2 through bottom process inlet 8, as indicated by the arrow at the bottom of tank 2, and exits from the interior of the liquid holding tank 2 through bottom process outlet 10, as also indicated by an arrow at the bottom of tank 2. An upper side of the tank 2 is fitted with a process overflow outlet 12, which coincides with the maximum tolerable upper limit of the liquid level 7. An observation window can be installed in the side of tank 2 at level 7 to enable an operator to view the liquid level 7, and the wave action when the system is in operation.

Combustion air is delivered to the nozzle mix burner 21 located in the top of the combustion chamber 4 by means of combustion air inlet line 22. The air is delivered to the burner 21 under pressure by blower (not shown). Natural gas for the nozzle mix burner 21 is delivered under pressure by a main natural gas line 26. As a general rule, 10 to 12 volumes of air are introduced per 1 volume of natural gas, in order to obtain complete and efficient combustion. A separate pilot gas line (not shown) is also connected to the nozzle mix burner 21. The pilot gas is used to establish a "minimum main flame" in the combustion chamber 4. A conventional spark type igniter (not shown) extends into the interior of the nozzle mix burner 21 and is used to ignite the pilot gas flame.

In typical operation, after a minimum main flame is started, the combustion air delivered through line 22 and natural gas delivered through main natural gas line 26, are mixed and injected through the downwardly extending nozzle (not shown) of burner 21. This produces a large "main flame" 31 (shown in dotted lines) which extends vertically downwardly and burns in the interior of the combustion chamber 4.

Hot gaseous combustion products for heating the liquid 6 are created by burning the combustion air and natural gas as a main flame 31 in the interior of the combustion chamber 4. The hot gaseous products of combustion generated by the flame 31 are expelled from the interior of the combustion chamber 4 through vertical slots 36 located in the bottom region of the combustion chamber 4. The hot gaseous products are expelled horizontally through the vertical slots 36 as bubbles in the liquid 6. After discharge through the slots 36, the hot products of combustion are in the form of thousands of very hot small gas bubbles (approximately 3000° F.) with very low density. In total, however, these thousands of small bubbles have a vast surface area. The bubbles, as they rise rapidly in liquid 6, shrink under the hydrostatic head of the liquid 6 and also due to cooling as heat is transferred from the hot bubbles to the liquid 6. As heat energy is transferred from the multitude of bubbles to the liquid 6, the transferred energy heats the liquid 6 while at the same time cooling the bubbles. Since the gas bubbles cause considerable turbulence, there are no liquid "dead spots". After the hot gaseous products of combustion bubbles have passed upwardly through the liquid 6, as a dispersion of thousands of tiny bubbles passed through secondary heat recovery dome 38, where more heat is extracted before they are exhausted through exhaust vent stack 30 located at the top of the dome 38, as indicated by the upwardly extending solid arrow. When the system is operating efficiently, all of the surplus heat in the gaseous bubbles is transferred into the liquid 6. Thus, when operating efficiently, the temperature of the exhaust gas in stack 30 will be about the same as the temperature of the heated liquid 6 exiting tank 2 at bottom process outlet 10.

The dimensions of the tank 2 and the dimensions of the combustion chamber 4 are typically sized so that maximum gas to liquid heating efficiency is obtained. Typically, the diameter of the tank 2 is approximately 3.5 times the diameter of the combustion chamber 4. The inventors have found that this ratio minimizes metal requirements while at the same time maximizing heat transfer, liquid heating, and hot liquid circulation.

Typically, the height of the combustion chamber 4 is approximately two times its horizontal diameter. These dimensions coordinate with the general dimensions of the tank 2 and permit rapid gas-air mixing and an efficient combustion flame 31 to emit downwardly from the inside top of the chamber 4 without touching the interior walls of the chamber 4 or the liquid 6. It is important that the flame 31 does not touch the cold walls of chamber 4 or the liquid 6 during operation because this reduces efficiency, leads to corrosion problems, and could "cold shock" extinguish the flame. Typically, the flame 31 will be at a temperature of about 3000° F. while the liquid 6 being heated will be between about 70° F. to about 160° F.

The base of the truncated conical top 11 which forms the top portion of the combustion chamber 4 is preferably at liquid level 7. In operation, when thousands of gas bubbles are being emitted through slots 36, and pass rapidly upwardly through liquid 6, inside jacket 48, and spill over the top as indicated by the arrow, considerable wave action is created at liquid level 7. This wave action washes over truncated cone 11 and cools it. Thus no extra cooling system is required as disclosed in U.S. Pat. No. 5,615,668.

When the submerged combustion heating system is in a dynamic state, the high wave action at the surface 7 of the liquid 6 washes over the exterior of the slanted walls of the truncated conical top 11. The exposed walls of truncated conical top 11 above the surface level 7 of liquid 6 must be cooled so that extreme temperature differences are avoided. If there were no liquid 6 washing over the outsides of the truncated conical top 11, the internal flame 31 at 3000° F. would heat the exposed walls of the truncated conical top 11 above the liquid 6 to destructive melt temperatures, while the bottom submerged portion of the walls of combustion chamber 4 would remain at the temperature of the liquid which is typically about 70° F. to 160° F.

The top of the burner sleeve 40 is welded or bolted to the top plate 3 of the combustion chamber 4. The cylindrical jacket 48 is open at the top and is welded at the bottom to the bottom 5 of the combustion tank 2. Additional struts and beams can be welded or bolted in the tank 2 and combustion chamber 4 as required to stabilize all components.

The combustion chamber 4 is constructed in the shape of a hollow vertical cylinder with an open bottom and slanted slots 36. The open bottom with the slots 36 is an important feature of the submerged combustion system. The open bottom ensures that no steam bubbles can collect on the underside of the combustion chamber 4. Prior constructions of combustion chambers have had flat bottoms, or recessed bottoms, which are easy and inexpensive to manufacture. However, flat bottom combustion chambers have been known to oxidize in relatively short order and have had to be replaced on a frequent basis.

The combustion chamber 4, with vertical slots 36 at the bottom region of the combustion burner 4, and a vertical cylindrical air bubble jacket 48 around the circumference of the combustion chamber 4. It will be noted in FIG. 1 that the slots 36 have a vertical orientation with angled upper ends. They are positioned in horizontal series at the bottom region of the side walls of the combustion tank 4. The vertical slots with slanted upper ends promote the generation of thousands of tiny hot combustion gas bubbles 45 at all levels of hot combustion gas flow.

During start-up of the submerged combustion heating system, when the liquid level 7 is at a static "rest" elevation, and there are no unequal pressures, the liquid 6 is at level 7 in the interior of the combustion chamber 4, as well as in the tank 2. However, when the interior of combustion chamber 4 is first purged by air from the air line 22, as required by safety regulations, the liquid level inside the chamber 4 is forced by the air pressure to drop to a level which completely clears the combustion chamber 4 of liquid 6. The liquid 6 is forced downwardly in combustion chamber 4 and out through the slots 36 and the open bottom.

During dynamic operation, the total area of the series of slots 36 must be sufficient to permit combustion gas to escape through the slots 36 at maximum velocities. These velocities can be as high as 50,000 feet/min. However, in many situations, the rate of the combustion heating system may be "turned down", that is, the rate of gas-air burning may be reduced to as low as 1:3. In that case, the generation of combustion gases is proportionally reduced so that the velocities are as low as 15,000 feet/min. through the slots 36. The design of the slots 36 must be capable of handling this wide variation in combustion gas velocities without creating problems such as gaseous eruptions from the open bottom of combustion chamber 4, vibration or backflow of liquid through some of the slots 36 into the interior of the chamber 4 due to the substantial head of the liquid 6 in the tank 2. It is also helpful to variable operation of the combustion heating system if wide variations in hot combustion gas flow through the slots 36 can be handled by the slots alone without having to have moving parts, which increase cost and maintenance problems.

The slots 36 must also be sufficiently numerous and small in area that they disperse the combustion gas horizontally into the liquid 6 at different levels in the form of thousands of small gas bubbles with maximum surface area (heat exchange area), maximum liquid mixing and maximum circulation action of the liquid 6 (with no cold zones), minimum bubble coalescence on the exterior of the chamber 4 which reduces heat exchange efficiency, and with only the desired level of liquid surface level 7 disturbance, since excessive waves and splashing reduce efficiency. However, some wave action is necessary so that the exterior of truncated conical top 11 is washed and cooled by the liquid 6.

Though a long process of trial and error, the inventors have discovered that vertical slots 36 with angled upper ends provide not only the flexibility to accommodate wide variations in hot combustion gas flow velocities but also generate thousands of small gas bubbles which are emitted at all levels but particularly at the angled upper portions to maximize both circulation in the liquid 6 and the exchange of heat from the gas bubbles into the liquid 6.

In evaluating different configurations for exhausting gas from the interior of combustion chamber 4, and particularly one level of ports, the inventors found that the combustion gases generated inside combustion chamber 4 tended to surge in bursts through a single elevation of ports. These surges caused an undesirable "rumbling" or vibration action, and excessive creation of bubbles, which in turn created an undesirable turbulence at the surface 7 of the liquid 6 in the tank 2 outside the chamber 4. The inventors have discovered by considerable experimentation that a series of vertical slots 36 as shown in FIG. 1, effectively deals with this problem. Apparently, but without wishing to be bound by any adverse theories, a large number of slots 36 with angled upper ends can accommodate reasonably wide variations in hot combustion gas flow velocity because the hot combustion gases are able to readily cope with the pressure created by the head of the liquid 6 outside the chamber 4 and select an appropriate number and level of slots 36 in order to flow into the liquid 6. The hot combustion gases thus escape smoothly through the slots 36 into the liquid 6 of the tank 2 without creating surges and eruptions. As can be recognized by persons skilled in the art, the pressure created by the sizable head of liquid 6 on the exterior of combustion chamber 4 is constantly attempting to force the liquid 6 to back flow through slots 36 into the interior of chamber 4. The flow of hot combustion gas through the slots 36 must therefore be sufficient to prevent this from occurring. The size and total area of the slots 36 must be sufficient to readily accommodate a wide range in volume and velocity of hot gaseous combustion product that is generated by the flame 31 in the combustion chamber 4.

The tendency of the hot combustion gas in dealing with the "head" of liquid 6 outside the combustion chamber 4 is to seek the path of least resistance, which of course is less "head". The hot gaseous products of combustion thus tend to be first expelled through the top angled portions of the slots 36. Hot gas bubbles are then forced from the interior of the combustion chamber 4 through the top angled parts of slots 36 into the liquid 6 in the tank 2 and rise to the surface 7 of the liquid 6 in the interior of the tank 2. If the volume of gas to be expelled through the top elevations of slots 36 is increased and is thus greater than can be accommodated by the sum of the angled areas of the slots 36, then some of the hot combustion gas will tend to be expelled through the lower vertical portions of slots 36 because this provides a greater total area through which the gas bubbles of the hot combustion products can be expelled from the interior of the combustion chamber 4 into the liquid 6 in the interior of the tank 2. Thus vertical slots 36 with angled upper ends are advantageous because it provides flexibility in dealing with the variable gas flow rates.

The size and number of the slots 36 is important as well. The sum of the total area of the slots 36 must obviously be large enough to handle the highest volume of hot combustion gases that are being generated in the interior of the chamber 4 and being expelled through the slots 36 into the liquid 6 in the tank 2. On the other hand, the size of the slots 36 should be as small as possible to encourage generating thousands of small bubbles. This means that the number of slots 54 should be relatively large in order to maximize gas dispersion, in the form of thousands of small bubbles, and minimize the generation of large bubbles which tend to surge out and create undesirable high turbulence at the liquid surface level 7 in the tank 2. Large bubbles also do not have much surface area and therefore interfere with efficient heat transfer of heat from the hot bubbles into the liquid 6.

As seen in FIG. 1, the liquid 6 to be heated is introduced into the tank 2 through bottom inlet 8. Typically, the liquid 6 to be heated is pumped into the tank 2 by a centrifugal type self-priming pump. A typical suitable pump is manufactured by Gorman Rupp. These pumps are able to handle liquids which contain a high degree of sediment, lumps and solid particles without clogging. The liquid 6 introduced through inlet 8 into tank 2 surrounds the combustion chamber 4 and is heated by combustion gas bubbles 45 which are generated by a flame 31, which extends downwardly from the air-natural gas mixing nozzle of burner 21 inside combustion chamber 4, almost the full height of the combustion chamber 4. It is important for efficient operation and long life that the flame 31 does not touch the interior walls of combustion chamber 4. The hot combustion gases generated by the flame 31 egress from the interior of combustion chamber 4 through slots 36 and travel as bubbles 45 upwardly inside jacket 48 through the tank liquid 6 to the surface which is indicated by level 7. The hot combustion gases then pass into the underside of secondary heat recovery dome 38 before passing through exhaust outlet 30 at the top of the dome 38. Meanwhile, the heated liquid pumped up inside jacket 48 spills over the top and into the main body of liquid 6 in the tank 2.

The inventors have discovered that the efficiency of the heat transfer of the hot combustion gases passing as thousands of small bubbles 45 upwardly through the liquid 6 in the tank 2 can be maximized if the temperature of the heated liquid 6 being pumped out of tank 2 through liquid outlet 10 is the same, or nearly the same, temperature as the temperature of the hot combustion gases exiting through exhaust 30. This equalized temperature means that heat transfer by direct contact of the hot gas bubbles 45 with the liquid 6 as they travel upwardly through liquid 6 to liquid level 7 and bubbles 58 as they pass upwardly through liquid 44 in the secondary heat recovery dome 38, is virtually 100 percent. This is a unique and inventive feature of the applicants' submerged combustion heating system. No other liquid heating systems have such a high efficiency. If the temperature of the exhaust gas exiting through exhaust 30 is higher than the temperature of the heated liquid 6 being pumped out through liquid outlet 10, then clearly all of the transferable heat in the exhaust gas 30 has not been utilized in heating the liquid 6. The applicants have also discovered that the maximum amount of heat in the hot combustion gas can be extracted by regulating the height (head) of the liquid level 7 and the liquid level 46 in the secondary heat recovery dome 38. For example, if the temperature of the exhaust gas 30 is significantly higher than the temperature of the liquid being pumped out through the outlet 10, then the height (head) of the liquid 6 or the height of the liquid 44 in dome 38 can be raised, so that the hot combustion gas bubbles 45 or 58 must pass vertically through a greater head of liquid 6 or 44 before exhausting through exhaust 30. In this way, the hot bubbles 45 or 58 are forced to travel through the liquid 6 or liquid 44 in dome 38 for a longer period of time and thus more heat is transferred from the hot gas to the liquid. If the head of either liquid 6 in tank 2 or liquid 44 in dome 58 is lowered, then the vertical distance the hot combustion gas bubbles 45 or 58 must travel through the respective liquids to be heated will be less, and accordingly less heat will be exchanged from the hot combustion gases into the liquid 6 or liquid 44 before they are exhausted through outlet 30. The liquid levels of liquid 6 and liquid 44 are adjusted by regulating the flow of liquid into and out of tank 2 and into and out of dome 38.

Instrumentation for controlling the applicants' method of maximizing transfer of heat from the hot combustion gases into the liquids to be heated is disclosed in U.S. Pat. Nos. 5,606,965 and 5,636,623. Thermocouples are installed at all critical temperature sensing sites. A thermocouple is connected to the exhaust stack 30. A suitable thermo-couple is manufactured by Honeywell Controls Inc. This thermocouple senses the temperature of the hot gases being exhausted through gas outlet 30. Similarly, a second thermocouple is connected to the hot liquid outlet 10, from which hot liquid 6 is being withdrawn by a pump. A recycle line 32 is connected between liquid 6 in the tank 2 and the liquid 44 in the dome 38. The second thermocouple senses the temperature of the hot liquid 6 being withdrawn through outlet 10. Other thermocouples sense the temperatures of the liquid 6 coming into inlet 8 and the liquid 44 coming into inlet 32 in dome 38. All the thermocouples are electronically connected to a programmed computer. The computer is programmed so that it is biased to equalizing the temperature being sensed by the first thermo-couple on the gas exhaust 30 and the temperature being sensed by the second thermo-couple on outlet 10. When the temperature sensed by the first thermo-couple is higher than the temperature re being sensed by the second thermo-couple, the computer will send a signal to the pump which regulates the quantity of cold liquid 6 being introduced into inlet 8. The pump will pump more liquid 6 into the tank 2 and raise the level 7 of the liquid 6. The head of the liquid 6 in tank 2 will rise accordingly until such time as the amount of he at being exchanged from the hot combustion gas bubbles 45 into the heated liquid 6 is increased to the point where the temperature of the exhaust gas in outlet 30 is equal or at most slightly higher than the temperature of the hot liquid 6 being withdrawn through outlet 10. Similar criteria and conditions apply to regulating the flow of liquid 44 into and out of recovery dome 38.

FIG. 1 also illustrates an embodiment of the submerged combustion heating system of the invention wherein a hollow cylindrical jacket 48 is placed around the exterior side walls of the combustion chamber 4. This jacket 48 is spaced from the exterior walls of the combustion chamber 4 and contains the thousands of hot gas bubbles 45 which are emitted through slots 36 and travel upwardly through the liquid 6.

The thousands of rapidly rising bubbles 45 in the liquid 6 that are contained in the annular space between the cylindrical combustion chamber 4 and the cylindrical jacket 48 creates a strong pumping action, which in turn requires that liquid 6 be drawn into the bottom of the jacket 48 through liquid inlet 8. This strong upward turbulent liquid pumping action created by the rapidly rising bubbles 45 enhances transfer of heat from the gas bubbles 45 to the liquid 6 in the annular space. The bubble pumping action also increases overall mixing of the liquid 6 in the tank 2, because the hot liquid 6 spills over the top of jacket 48 and mixes with the liquid 6 contained on the outside of the jacket 48.

The jacket 48 also has the advantage that the liquid 6 with contained gas bubbles 45 emerges rapidly from the top of the annular space between the jacket 48 and the top of the combustion chamber 4 to thereby create a strong wave action which washes over and cools the exterior surface of the truncated conical top 11 of the combustion chamber 4.

Figure 2:
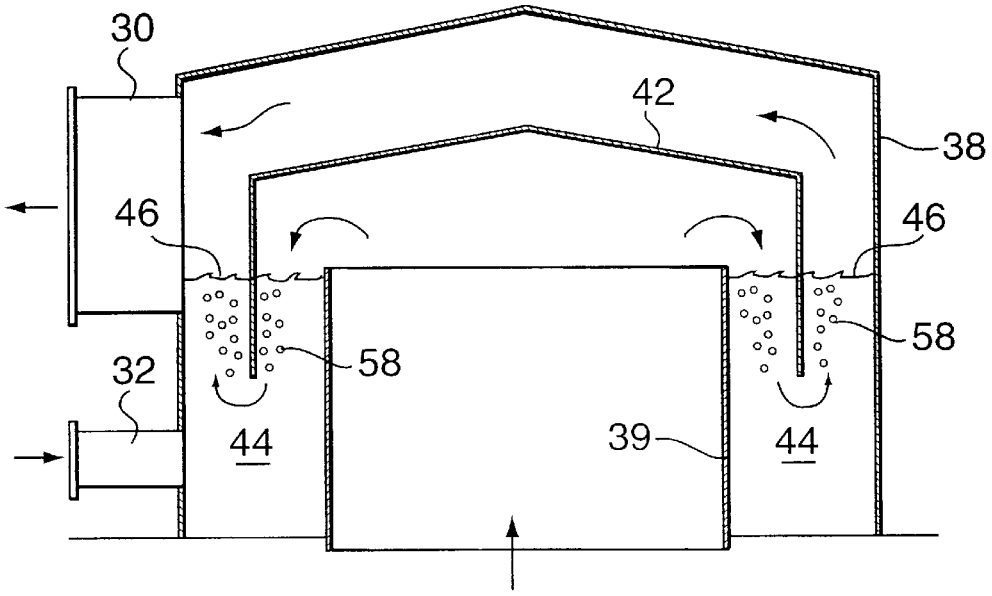
FIG. 2 illustrates an elevation section view of the secondary heat recovery dome.

FIG. 2 illustrates a detailed section view of an embodiment of the secondary heat recovery dome 38 which differs in some respects from the secondary heat recovery dome 38 shown in FIG. 1. The exterior dome 38 has a smaller dome 42 spatially mounted inside it. Extending upwardly inside the smaller dome 42 is a cylindrical pipe 39, the bottom of which is connected to and open with the top combustion gas space of tank 2. Hot liquid 6 that is withdrawn from tank 2 through liquid outlet 10 is pumped into the annular space between recovery dome 38 and small dome 42 through inlet 32 to form a "water trap" of liquid 44. Hot combustion gases that are delivered through pipe 39 into small dome 42 are forced to pass through the hot liquid 44 before passing into the top interior of recovery dome 38 and exiting through gas exhaust 30 (which in FIG. 2 is shown at the upper exterior left side of recovery dome 38, rather than at the top as shown in FIG. 1). In this way, the hot combustious gases have a second opportunity to heat the liquid 44 to a level above 132° F. which is the dew point of water. As liquid 44 is continually introduced into dome 38 through inlet 32, it spills over the top lip of pipe 39 and down into tank 2 where it joins liquid 6 in tank 2.

Figure 3:
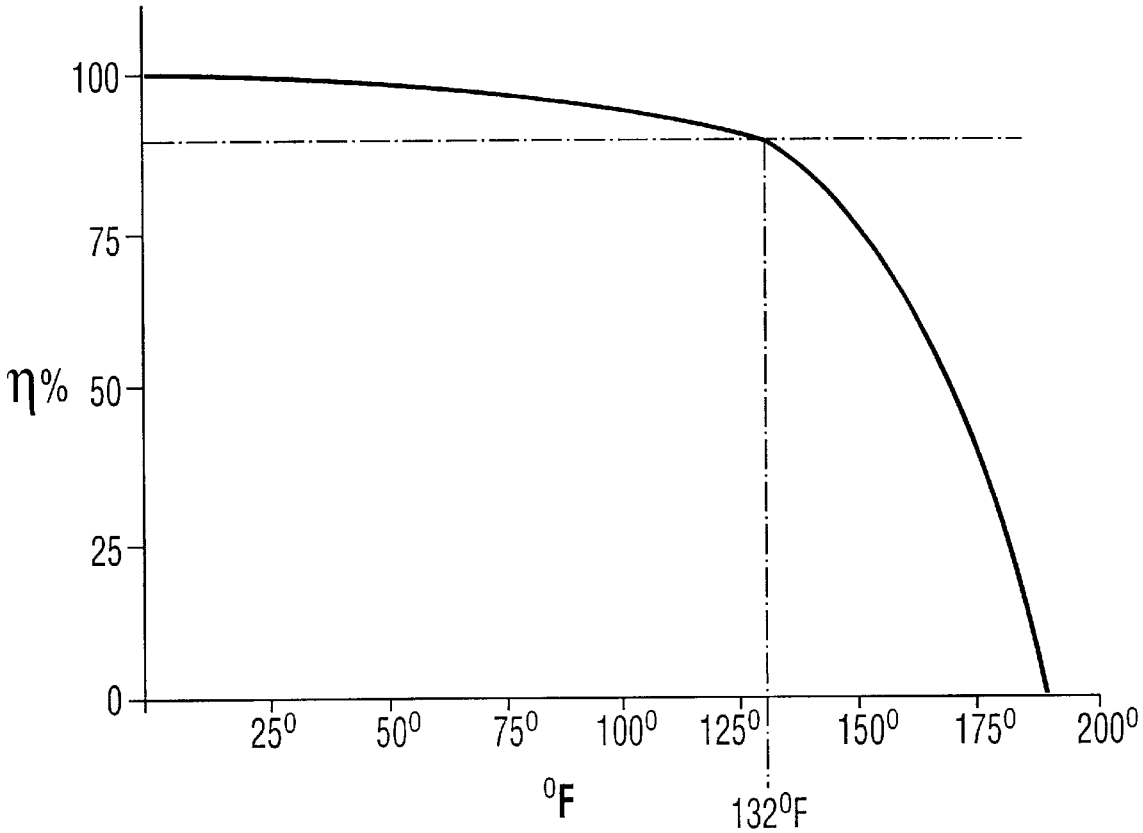
FIG. 3 illustrates a graph of heat transfer efficiency plotted against temperature for heated water.

FIG. 3 illustrates a graph showing a plot of percentage heat transfer efficiency against temperature for hot water, and illustrates in particular the water dew point of 132° F. As can be seen, the efficiency curve drops rapidly after the dew point of 132° F. is reached. Beyond 132° F., the bulk of the heat that is delivered to the liquid is taken up with evaporation. To increase heating efficiency when heating the liquid beyond 132° F., the secondary heat recovery system provided by secondary heat recovery dome 38 has been invented, and is an important feature of the applicant's invention. Efficiently heating the liquid to temperatures higher than 132° F. is important in many situations, for example, in applications where the liquids-solids must be pasteurized. For instance, a recently enacted United States Federal Statute now requires that municipal solids-liquids wastes must be heated to a temperature of at least 158° F. for a minimum of 30 minutes.

Figure 4:
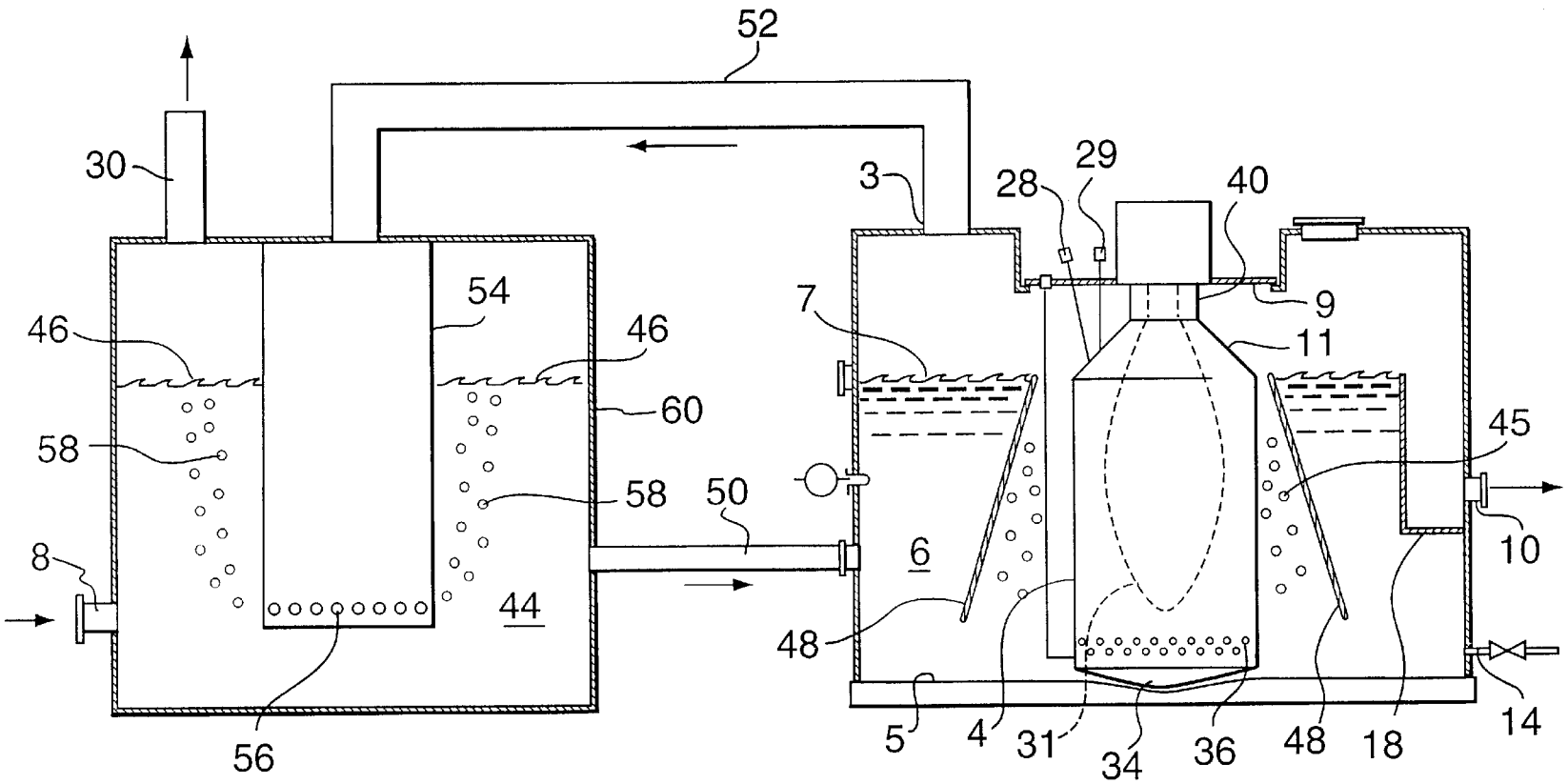
FIG. 4 illustrates an elevation view of an alternative embodiment of lowered combustion chamber with a vertical upwardly tapered air bubble jacket around the circumference of the combustion chamber, and a separate secondary heat recovery unit.

FIG. 4 illustrates a further embodiment of the primary and secondary heat recovery system according to the invention. The cold liquid at ambient temperatures is introduced into secondary heat recovery tank 60. There it is heated by hot combustion gas that is passed as bubbles 58 from hot air chamber 54 and emitted through ports 56. The liquid 44 in tank 60 has a liquid level 46. After passing through liquid 44 as bubbles 58, the gas is exhausted through stack 30. The heated liquid 44 is then delivered through liquid connector 50 and becomes liquid 6 in tank 2. In tank 2, the liquid 6 is heated by hot combustion gas generated in combustion chamber 4, as previously described. The hot combustion gas which is bubbled through liquid 6, and heats it, is delivered through gas connector 52 to the interior of hot air chamber 54, from which it is emitted through ports 56 through liquid 44, as previously described.

Advantages of the Submerged Combustion System

The submerged combustion heating system has a large number of advantages over other liquid heating systems:

1. Over 90% efficiency, which is at least 10% higher than the next most efficient liquid heating system.
2. Uniform temperatures throughout the liquid in the primary tank and the secondary heat recovery tank or dome due to strong liquid agitation by thousands of bubbles.
3. One or two liquid holding tanks of compact design, depending on liquid or liquid-solids type, which permits the tanks to act as reaction vessel, due to the strong mixing action developed.
4. Non-pressurized combustion tanks which function at atmospheric temperature and can be easily operated by maintenance personnel. Operation of the submerged combustion system does not require a Certified Operating Engineer. The maintenance personnel can easily enter the tank and perform maintenance tasks.
5. The two stage submerged combustion heating system has a simple, safe, and reliable design which provides years of trouble free service.

Submerged Combustion Operation

During typical submerged combustion heating system start-up, a five-second automatic pre-ignition purge is used to evacuates liquid from the combustion chamber. A PLC-based burner management system supervises and controls all interlocks and upon proof of pilot ignition, permits the main burner 21 to be ignited. During operation, the heat input is controlled by sensing the temperature of the liquid at the point of discharge through liquid outlet 10. The liquid level 7 in the tank 2 is constantly monitored and interlocked by means of an air bubble liquid level sensing system.

In an alternative system, several submerged combustion heating systems can be used simultaneously, arranged in a grid system, excluding the tanks 2 in a pond or a large holding tank. The combustion chambers 4 can be partially submerged directly into the liquid to be heated. In that case, a the hot combustion gases are expelled from the bottom slots 36 in the combustion chambers 4 directly into the liquid reservoir and the cooled combustion gas rising from the liquid surface is exhausted directly to the atmosphere. The heated liquid is pumped from the reservoir, while cold liquid is supplied to the reservoir.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A submerged combustion heating system comprising:

(a) a first liquid holding vessel constructed to contain a liquid, said first holding vessel having a liquid inlet and a liquid outlet, and an exhaust gas outlet;

(b) a combustion chamber having an open bottoms an interior, and interior walls, said combustion chamber positioned in an interior of the first vessel, at least a bottom portion of the combustion chamber being located below a top elevation of the vessel and in the liquid in the first vessel;

(c) fuel and air conveyors associated with the combustion chamber for conveying fuel and air into the interior of the combustion chamber, said fuel and air being ignited to create a combustion flame inside the combustion chamber, said flame not touching the interior walls of the combustion chamber or the liquid, said flame generating a hot combustion gas;

(d) a plurality of openings located in the combustion chamber for enabling the hot combustion gas to be exhausted from the interior of the combustion chamber into liquid in the first vessel below a level of liquid in the first vessel and heating the liquid in the first vessel;

(e) a second liquid holding vessel having an interior, said second vessel connected to the fist vessel and holding liquid;

(f) a hot air chamber positioned in the interior of the second liquid vessel and connected with the first vessel, said hot air chamber being connected to and receiving hot combustion gas from the first vessel and exhausting the hot combustion gas through the liquid in the second liquid holding vessel and heating the liquid in the second vessel, wherein the first vessel is a hollow cylindrical vessel, having vertical walls, a first bottom, a first top and a first vertical longitudinal axis, and the combustion chamber is a smaller hollow cylindrical vessel which has vertical walls, a second bottom, a second top, a second vertical longitudinal axis coincident to the first longitudinal axis of the first cylindrical vessel, and the plurality of openings is located in a lower region of the smaller cylindrical vessel, and wherein the combustion chamber is enclosed by a jacket and hot combustion gas from the combustion chamber openings passes through the liquid in the first vessel between the combustion chamber and the jacket.

2. A submerged combustion system as claimed in claim 1 wherein the jacket surrounding the combustion chamber is in a shape of a hollow cylinder.

3. A submerged combustion system as claimed in claim 1 wherein the jacket is tapered in an upwardly direction.

4. A submerged combustion system as claimed in claim 3 wherein the jacket is tapered in an upwardly direction.

5. A submerged combustion heating system comprising:

(a) a first liquid holding vessel constructed to contain a liquid, said first holding vessel having a liquid inlet and a liquid outlet, and an exhaust gas outlet;

(b) a combustion chamber having an open bottom, an interior, and interior walls, said combustion chamber positioned in an interior of the first vessel, at least a bottom portion of the combustion chamber being located below a top elevation of the vessel and in the liquid in the first vessel;

(c) fuel and air conveyors associated with the combustion chamber for conveying fuel and air into the interior of the combustion chamber, said fuel and air being ignited to create a combustion flame inside the combustion chamber, said flame not touching the interior walls of the combustion chamber or the liquid, said flame generating a hot combustion gas;

(d) a plurality of openings located in the combustion chamber for enabling the hot combustion gas to be exhausted from the interior of the combustion chamber into liquid in the first vessel below a level of liquid in the first vessel and heating the liquid in the first vessel;

(e) a second liquid holding vessel having an interior, said second vessel connected to the first vessel and holding liquid;

(f) a hot air chamber positioned in the interior of the second liquid vessel and connected with the first vessel, said hot air chamber being connected to and receiving hot combustion gas from the first vessel and exhausting the hot combustion gas through the liquid in the second liquid holding vessel and heating the liquid in the second vessel, wherein the second liquid holding vessel has a conduit which introduces hot combustion gas into the second liquid holding vessel and he conduit has a cap thereon which forces the hot combustion gas to pass through the liquid in the secondary holding vessel.

6. A submerged combustion system as claimed in claim 5 wherein the liquid in the second holding vessel is liquid obtained from the first liquid holding vessel.

* * * * *